US005959588A

United States Patent [19]

Johannisson et al.

[11] Patent Number: 5,959,588

[45] Date of Patent: Sep. 28, 1999

[54] DUAL POLARIZED SELECTIVE ELEMENTS FOR BEAMWIDTH CONTROL

[75] Inventors: Björn Johannisson, Kungsbacka; Peter Svedhem, Fjärås; Lars Torstensson, Göteborg, all of Sweden

[73] Assignee: Telefonaktiebolaget LM Ericsson, Stockholm, Sweden

[21] Appl. No.: 08/780,332

[22] Filed: Jan. 8, 1997

[30] Foreign Application Priority Data

Jan. 19, 1996 [SE] Sweden ..... 9600206

[51] Int. Cl.[6] ..... H01Q 19/00

[52] U.S. Cl. ..... 343/756; 343/909

[58] Field of Search ..... 343/700 MS, 756, 343/846, 848, 909; H01Q 1/38, 19/00, 21/20

[56] References Cited

U.S. PATENT DOCUMENTS

| | | | |
|---|---|---|---|
| 3,148,370 | 9/1964 | Bowman | 343/909 |
| 3,721,988 | 3/1973 | Schwartz et al. | 343/756 |
| 4,070,676 | 1/1978 | Sanford | 343/700 MS |
| 4,415,900 | 11/1983 | Kaloi | 343/700 MS |
| 4,772,890 | 9/1988 | Bowen et al. | 343/700 MS |
| 4,791,423 | 12/1988 | Yokoyama et al. | 343/700 MS |
| 4,821,040 | 4/1989 | Johnson et al. | 343/700 MS |
| 5,311,202 | 5/1994 | Popp et al. | 343/909 |
| 5,502,453 | 3/1996 | Tsukamoto et al. | 343/700 MS |
| 5,543,815 | 8/1996 | Wu et al. | 343/909 |

FOREIGN PATENT DOCUMENTS

| | | |
|---|---|---|
| 0497181 | 7/1992 | European Pat. Off. . |
| 2251520 | 8/1992 | United Kingdom . |

*Primary Examiner*—Don Wong
*Assistant Examiner*—Tan Ho
*Attorney, Agent, or Firm*—Burns, Doane, Swecker & Mathis, L.L.P.

[57] ABSTRACT

A dual polarized antenna comprises at least one radiating element and a ground plane. The ground plane is, at least partly, provided with a side wall. At least one polarization selective element is provided between the radiating element and the side wall to transmit one of the polarizations and to determine the radiation pattern of the other polarization.

8 Claims, 1 Drawing Sheet

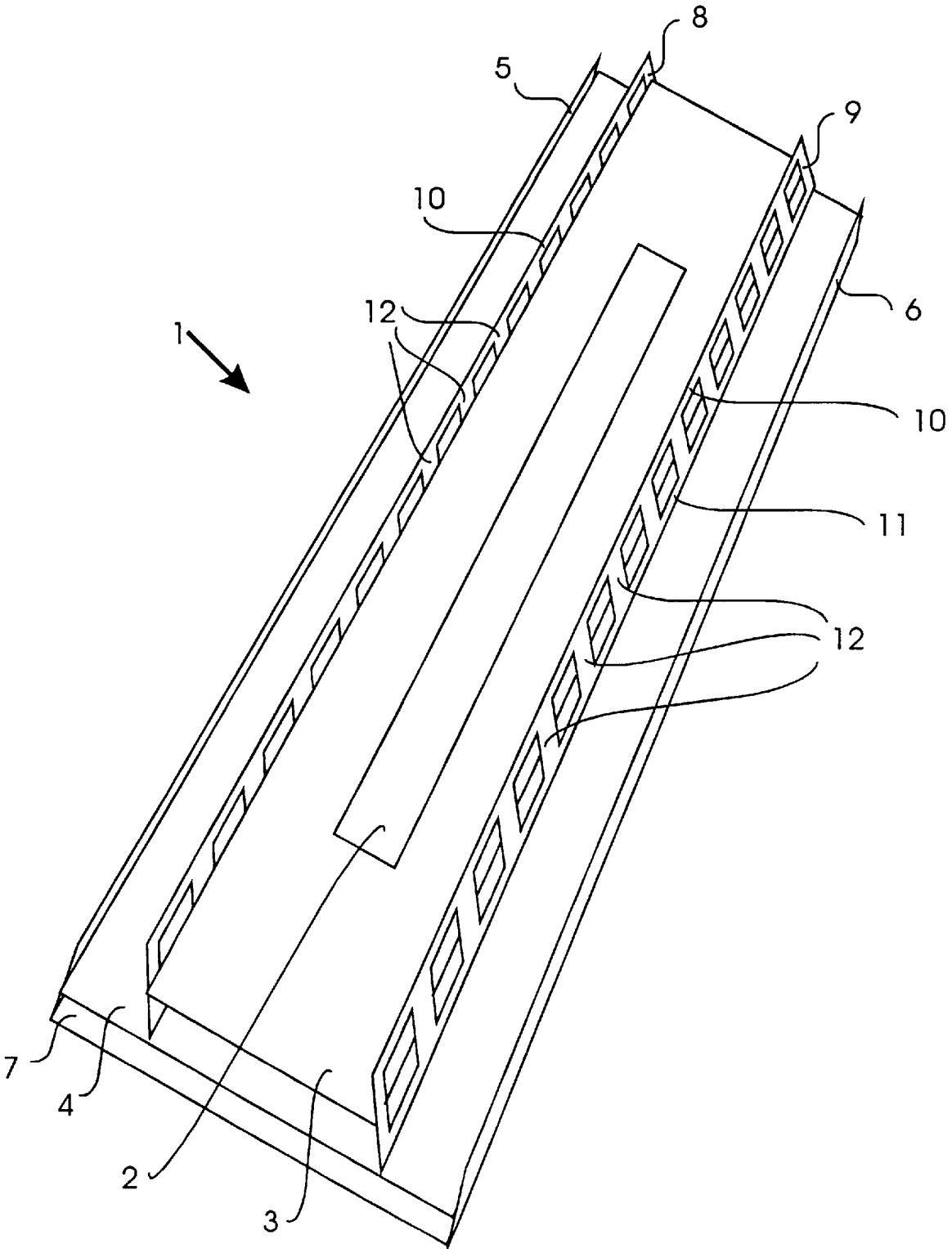
8
5
9
10
6
12
1
10
11
12
7
4
2
3

DUAL POLARIZED SELECTIVE ELEMENTS FOR BEAMWIDTH CONTROL

BACKGROUND

The invention relates generally to an antenna, and more specifically to a dual polarized antenna for use in a cellular base station.

In traditional cellular base stations, vertically polarized antennas are used. These antennas often have a wide antenna beam in azimuth, e.g. 120°. To increase the performance of the base station, two antennas may be mounted at a sufficient distance from each other to enable space diversity.

A similar increase in performance can be obtained by instead using polarization diversity. Two different, e.g. mutually orthogonal, polarizations from one and the same antenna can be used as diversity channels.

In antennas that are to be used in connection with polarization diversity, it is important that the two polarizations have the same antenna patterns, and that each polarization vector maintains its direction for all azimuth angles.

In a vertically linear antenna array for sector coverage, the radiating elements can be of different types, e.g. microstrip patch elements or dipoles. Also, a ground plane can be included in the antenna array.

One purpose of this ground plane, is to form the desired radiation pattern. To get the desired beam width, the ground plane is at least partly surrounded by side walls. These side walls will at the same time strengthen the antenna structure mechanically and hold interior parts of the antenna in place.

However, due to the electromagnetic properties of the edge of such side walls, vertical and horizontal polarizations will be affected differently. With side walls along the sides of the radiating element or elements, the beam width of the vertically polarized signal will be different from the beam width of the horizontally polarized signal.

If another combination of two polarizations is used to obtain polarization diversity, the edge effects may cause differences between the two polarizations both in the beam patterns and in the polarization vector directions. The effect for e.g. a pair of +/−45° polarization directions is typically a rotation of the polarization vector rather than a beam width difference.

SUMMARY

The object of the invention is to bring about a dual polarized antenna which does not cause differences in radiation patterns and/or polarization vector directions between the two polarizations.

This is attained in the antenna according to the invention, mainly in that it is provided with at least one polarization selective element which transmits one of the polarizations and determines the radiation pattern of the other.

Hereby, in the dual polarized antenna, both radiation patterns can be controlled by proper selection of the design and location of the polarization selective element.

BRIEF DESCRIPTION OF THE DRAWING

The invention will be described more in detail below with reference to the appended drawing, on which the single FIGURE is a schematical perspective view of an embodiment of an antenna according to the invention.

DETAILED DESCRIPTION

The FIGURE schematically illustrates an embodiment of a dual polarized antenna 1 in accordance with the principles of the present invention.

The antenna 1 shown comprises a schematically illustrated dual polarized radiating element 2, e.g. in the form of a microstrip patch element. Even if just one radiating element 2 is shown, it is to be understood that there can be a plurality of radiating elements in the antenna 1.

In the embodiment shown, the radiating element 2 is supported on a plate 3 of an insulating material.

In its turn, the plate 3 with the radiating element 2 is supported, in a manner not shown, by a somewhat larger plate 4. This plate 4 constitutes the ground plane of the antenna 1 and may be made of an insulating material provided with a layer of a conducting material. As apparent from the Figure, the plate 3 may be supported at a distance from the plate 4, i.e. the ground plane.

In the embodiment shown, the plate or ground plane 4 is received in grooves (not shown) in the side walls 5 and 6 of a U-shaped profile, having a flat bottom 7. The U-shaped profile including the bottom 7 and the side walls 5 and 6, is made of a conducting material.

To eliminate any differences between the two polarizations of the radiating element 2 in the beam patterns as well as in the polarization vector directions, caused by the edges of the side walls 5 and 6, the antenna 1, in accordance with the invention, is provided with at least one polarization selective element.

Each polarization selective element which is made of a conducting material, is adapted to transmit one of the polarizations from the radiating element 2 and to act as a side wall, i.e. determine the radiation pattern, for the other polarization.

In the embodiment shown, there are two polarization selective elements. The polarization selective elements shown are fence-like structures 8 and 9 which are located on the ground plane 4. The fence-like structures 8 and 9 extend parallel to the side walls 5 and 6, respectively, of the U-shaped profile, on either side of the radiating element 2.

As shown, each fence-like structure 8 and 9 in this embodiment, includes a top bar 10 which is interconnected with a bottom bar 11 by means of a number of cross bars 12.

The distance between the cross bars 12 should be selected to less than $0.1\lambda$, $\lambda$ being the wavelength of the antenna 1.

In the embodiment shown with the fence-like structures 8 and 9 extending parallel to the respective side walls 5 and 6, the antenna pattern for one polarization is determined mainly by the position and height of the fence-like structures 8 and 9, while the antenna pattern for the other polarization is determined mainly by the position and height of the side walls 2 and 3.

Thus, by means of the fence-like structures 8 and 9, the two antenna patterns can be controlled independently of each other.

In the embodiment shown, the bottom 7 of the U-shaped profile as well as the insulating plate 3 and the ground plane 4 are all rectangular with the side walls 5 and 6 as well as the fence-like structures 8 and 9 extending along the long sides.

However, the ground plane 4 and the insulating plate 3 as well as any structure supporting these elements may be square or even circular. In the latter case, there would be only a single side wall (not shown) and only one fence-like structure (not shown) extending parallel to that single side wall.

According to another, not illustrated embodiment of the antenna in accordance with the invention, each fence-like structure is inclined relative to the respective side wall. The fence-like structure may be inclined either towards or away from the respective side wall.

If the fence-like structure is inclined towards the respective side wall, the top portion of the respective fence-like structure may contact the top of the respective side wall.

Depending on the application of the antenna, the fence-like structures may extend, not along the whole length of the side wall, but only along part thereof.

What is claimed is:

1. A dual polarized antenna, comprising:

at least one radiating element;

a ground plane at least partly surrounded by a side wall; and at least one polarization selective element, located between a radiating element and the side wall, which is adapted to transmit one of the polarizations and to determine a radiation pattern of the other polarization to independently control the beamwidths of the radiation patterns of the two polarizations.

2. The antenna of claim 1, wherein the at least one polarization selective element extends parallel to the side wall.

3. The antenna of claim 1, wherein the at least one polarization selective element is inclined relative to the side wall.

4. The antenna of claim 3, wherein the at least one polarization selective element is inclined toward the side wall.

5. The antenna of claim 1, wherein the at least one polarization selective element extends along a whole length of the side wall.

6. The antenna of claim 1, wherein the at least one polarization selective element is a fence structure.

7. The antenna of claim 6, wherein the fence structure comprises a top bar that is interconnected with a bottom bar by cross bars.

8. The antenna of claim 1, wherein the ground plane is rectangular and has side walls along its long sides, and the polarization selective element is disposed between the radiating element and the side walls.

* * * * *